US007678434B2

(12) United States Patent
Phillips

(10) Patent No.: US 7,678,434 B2
(45) Date of Patent: Mar. 16, 2010

(54) THERMALLY-ENHANCED HVAC CONSTRUCTIONS

(75) Inventor: Patrick Phillips, Cynthiana, KY (US)

(73) Assignee: York International Corporation, York, PA (US)

( * ) Notice: Subject to any disclaimer, the term of this patent is extended or adjusted under 35 U.S.C. 154(b) by 894 days.

(21) Appl. No.: 10/837,184

(22) Filed: Apr. 30, 2004

(65) Prior Publication Data

US 2005/0244597 A1 Nov. 3, 2005

(51) Int. Cl.
*B32B 17/00* (2006.01)
*B32B 18/00* (2006.01)
*E04B 1/00* (2006.01)

(52) U.S. Cl. ..... 428/34.1; 52/220.1; 52/272; 428/68; 428/210

(58) Field of Classification Search ..... 428/68, 428/34.1, 126, 210; 52/220.1, 272
See application file for complete search history.

(56) References Cited

U.S. PATENT DOCUMENTS 3,302,414 A * 2/1967 Sudmeier ..... 62/3.61
3,955,034 A * 5/1976 Fletcher et al. ..... 428/215
4,015,386 A 4/1977 Cook
4,039,487 A * 8/1977 Kolakowski et al. ..... 521/129
4,122,203 A 10/1978 Stahl
4,221,835 A 9/1980 Severus-Laubenfeld
4,223,068 A 9/1980 Carlstrom et al.
4,254,177 A 3/1981 Fulmer
4,361,613 A 11/1982 Bogner et al.
4,463,043 A * 7/1984 Reeves et al. ..... 428/68
4,530,877 A 7/1985 Hadley
4,732,796 A * 3/1988 Schatschneider ..... 428/34.1
4,871,477 A 10/1989 Dimanshteyn
4,936,064 A 6/1990 Gibb
4,961,298 A 10/1990 Mogradi
5,009,952 A 4/1991 Klepsch et al.
5,098,778 A 3/1992 Minnick
5,102,919 A 4/1992 Swab
5,170,603 A 12/1992 Bartlett
5,286,320 A 2/1994 McGrath et al.
5,500,305 A 3/1996 Bridges et al.
5,522,194 A 6/1996 Granlich
5,654,060 A * 8/1997 Holman et al. ..... 428/68

(Continued)

FOREIGN PATENT DOCUMENTS

WO WO 99/00559 1/1999

(Continued)

*Primary Examiner*—Brent T O'Hern
(74) *Attorney, Agent, or Firm*—McNees Wallace & Nurick, LLC

(57) ABSTRACT

A thermally-enhanced, insulated component for use with an HVAC system includes a component having an outer surface usable with an HVAC system, the component being substantially filled with an insulating material. A thin, dimensionally stable layer of thermal barrier material having opposed surfaces is disposed inside the component at a predetermined distance from the outer surface of the component. The thermal barrier layer is in contact with the insulating material on at least one surface of the opposed surfaces. When the outer surface of the component is subjected to an elevated temperature, the thermal barrier layer maintains a sufficient temperature differential between the surface of the opposed surfaces of the thermal barrier layer facing opposite the outer surface and the surface of the opposed surfaces of the thermal barrier layer facing the outer surface so that the insulating material produces a reduced rate of smoke.

23 Claims, 13 Drawing Sheets

U.S. PATENT DOCUMENTS

| | | | | |
|---|---|---|---|---|
| 5,955,177 | A * | 9/1999 | Sanocki et al. | 428/210 |
| RE36,674 | E | 4/2000 | Gluck et al. | |
| 6,096,416 | A | 8/2000 | Altenberg | |
| 6,240,691 | B1 | 6/2001 | Holzkaemper et al. | |
| 6,383,608 | B1 | 5/2002 | Burkett et al. | |
| 6,589,646 | B1 | 7/2003 | Morgenstern | |
| 6,694,038 | B1 * | 2/2004 | Azima | 381/423 |
| 6,716,520 | B2 * | 4/2004 | Cook, II | 428/314.4 |
| 2003/0082357 | A1 * | 5/2003 | Gokay et al. | 428/212 |
| 2005/0055917 | A1 * | 3/2005 | Dubensky et al. | 52/302.1 |

FOREIGN PATENT DOCUMENTS

| | | |
|---|---|---|
| WO | WO 99/21712 | 5/1999 |

* cited by examiner

THERMALLY-ENHANCED HVAC CONSTRUCTIONS

FIELD OF THE INVENTION

The present invention is directed to thermally-enhanced HVAC constructions or components, and more particularly, is directed to thermally-enhanced foam-filled HVAC constructions or components.

BACKGROUND OF THE INVENTION

Heating, ventilation and air conditioning ("HVAC") systems are commonly used in many climate control applications. Air Handling Units (AHUs) are one of several components in HVAC systems. They are an important component as the AHU houses a number of components used in the system to provide forced air for climate control in a particular structure. AHU components typically include motors, heating/cooling coils, and blowers as well as the required interface connections to these components to effect such climate control.

The AHU is an enclosed interconnected framed panel structure. The framed panel structures have insulated panels that are supported between framing members, also referred to as raceways, to define interconnected rectangular compartments. Typically, the insulating material used in the panel is polyurethane foam that may be installed as a block, or injected as a foam, which cures to form a core within the panel.

Polyurethane foam insulation has superior insulating and indoor air quality ("IAQ") properties versus fiberglass insulation. Although fiberglass has been the insulation of choice in many industries, foam insulation has become favored over fiberglass due to its reduced construction costs and increased energy savings potential. Foam insulation is currently heavily utilized in many industries, including household appliances (refrigerators, freezers), walk-in coolers (grocery stores, food processing plants) and HVAC units (AHUs and packaged products). However, a significant drawback to foam-insulated products is smoke generation when subjected to elevated temperatures, such as those generated during a fire. Smoke generation, or smoke spread, by foam-insulated panels is significantly increased with panels having thicknesses exceeding approximately one-half inch to one inch, depending upon the type of insulating material used, which thickness is typically exceeded to provide adequate insulating performance. While additives may be added to the foam insulation mixture to enhance flame retardant characteristics, those same chemicals typically adversely affect the smoke spread characteristics.

Flame and smoke generation indexes are predominantly measured utilizing a test conducted in accordance with the procedure outlined by the American Society for Testing and Materials in ASTM E 84-01, "Standard Test Method for Surface Burning Characteristics of Building Materials" (the National Fire Protection Agency in NFPA 255, the American National Standards Institute/Underwriters Laboratories in ANSI/UL 723 and the Uniform Building Code in UBC 8-1).

The index is based on a standard that is given a value of 100, such as red oak having a pre-determined moisture content. Therefore, any measured index value is compared to the standard value, and typically, fractional portions of the standard value are selected as classifications within an industry. Different industries permit differing levels of flame and smoke generation. The walk-in cooler industry, for instance, uses standards that allow a smoke generation index as high as 450 per ASTM E84, which can be easy to achieve, but uses a flame spread designation that is typically classified as Class I, which corresponds to a flame spread index of no higher than 25, or one-fourth of the index of red oak. Thus, walk-in cooler industry places more emphasis on the rate of flame spread as a measure of safety.

A low flame spread index can be achieved in foam-filled panels by mixing the foam with readily available flame-retardants. Foam insulation for panels and walls with one-half inch thickness or less typically contains a minimal amount of foam insulation material, thus enabling the panel to pass the common 25 flame and 50 smoke index requirements of NFPA 90A per ASTM E84. However, foam-insulated panels and walls greater than one-half inch in thickness must typically use additional materials or components to minimize heat transfer, and lower smoke generation index values to meet the above smoke index requirement, or utilize agency listings (UL, Environmental Technology Laboratory ("ETL")) to provide "proof" of safety. To provide the required amount of insulation, panels used with HVAC systems must typically be substantially thicker than one-half inch.

Per standard building codes, the outer casing material of panels for HVAC systems must typically provide a 15-minute flame barrier, such that the flame does not come into direct contact with the insulating material, if present, which is typically flammable material. However, even with outer casing materials that provide a 15-minute barrier, the flame/smoke performance characteristics of the panel typically do not sufficiently improve. That is, without an additional thermal barrier material or component, a foam panel insulation system will not meet the 25/50 flame/smoke generation requirements of NFPA 90A per ASTM E84.

What is needed is a thermal barrier material or component that can be used with household appliances, walk-in coolers and HVAC units and provides improved flame/smoke performance characteristics.

SUMMARY OF THE INVENTION

The present invention relates to a thermally-enhanced component for use with an air handling unit including a substantially enclosed structure having an interior surface and an exterior surface. At least one sheet of a non-woven ceramic material has opposed surfaces being disposed inside the structure at a predetermined distance from the exterior surface of the structure, the at least one sheet being configured to provide a thermal barrier. Insulating material is disposed inside the structure and in contact with at least one surface of the at least one sheet, the insulating material having a predetermined rate of smoke generation at a predetermined temperature. Wherein upon the exterior surface of the structure being subjected to the predetermined temperature sufficient to produce smoldering of the insulating material disposed inside the structure, the at least one sheet providing a sufficient temperature differential between the opposed surfaces of the at least one sheet to reduce the predetermined rate of smoke generated by the insulating material. For purposes herein, smoldering is defined as to burn sluggishly, with or without flame, and often with much smoke, or to be consumed by smoldering. Thus, the terms "smolder" and "consume" when used in the context of the insulating material are understood to characterize the condition of insulating material that produces smoke in response to the insulating material being exposed or subjected to sufficient heat.

The present invention further relates to a thermally-enhanced component for use with an HVAC system including a substantially enclosed structure having an interior surface and an exterior surface, the structure being substantially filled with an insulating material. At least one sheet of a non-woven ceramic material having opposed surfaces is disposed inside the structure at a predetermined distance from the exterior surface of the structure, the at least one sheet being configured to provide a thermal barrier. Insulating material is disposed inside the structure and in contact with at least one surface of the at least one sheet, the insulating material having a predetermined rate of smoke generation at a predetermined temperature. Wherein upon the exterior surface of the structure being subjected to the predetermined temperature sufficient to produce smoldering of the insulating material disposed inside the structure, the at least one sheet provides a sufficient temperature differential between the opposed surfaces of the at least one sheet to reduce the predetermined rate of smoke generated by the insulating material.

The present invention also relates to a thermally-enhanced component for use with an HVAC system including a substantially enclosed structure having an interior surface and an exterior surface. At least one sheet of a non-woven ceramic material has opposed surfaces being disposed inside the structure at a predetermined distance from the exterior surface of the structure, the at least one sheet being configured to provide a thermal barrier. Wherein upon the exterior surface of the structure being subjected to a reduced temperature associated with refrigeration cycles, the at least one sheet provides a sufficient temperature differential between the opposed surfaces of the at least one sheet such that condensation is substantially prevented from forming along the exterior surface of the structure.

The present invention additionally relates to a component for separating different regions of a structure including a substantially enclosed structure having an interior surface and an exterior surface. At least one sheet of a non-woven ceramic material having opposed surfaces is disposed inside the structure at a predetermined distance from the exterior surface of the structure, the at least one sheet being configured to provide a thermal barrier. Insulating material is disposed inside the structure and in contact with at least one surface of the at least one sheet, the insulating material having a predetermined rate of smoke generation at a predetermined temperature. Wherein upon the exterior surface of the structure being subjected to the predetermined temperature sufficient to produce smoldering of the insulating material disposed inside the structure, the at least one sheet providing a sufficient temperature differential between the opposed surfaces of the at least one sheet to reduce the predetermined rate of smoke generated by the insulating material.

The present invention further relates to a component for separating different regions of a structure which includes a substantially enclosed structure having an interior surface and an exterior surface. At least one sheet of non-woven ceramic material having opposed surfaces is disposed inside the component at a predetermined distance from the outer surface of the component to form a thermal barrier layer. The thermal barrier layer is in contact with the insulating material on at least one surface of the opposed surfaces of the thermal barrier layer. Upon the outer surface of the component being subjected to an elevated temperature sufficient to produce smoldering of insulating material, the thermal barrier layer maintains a sufficient temperature differential between the opposed surfaces of the thermal barrier layer such that a reduced rate of smoke, if any, is produced.

An advantage of the present invention is improved flame/smoke performance characteristics for household appliances, walk-in coolers and air conditioning units.

A yet further advantage of the present invention is insulated panels having improved acoustic attenuation characteristics in household appliances, walk-in coolers and air conditioning units.

A still further advantage of the present invention is that it that may prevent the formation of condensation on the outer surfaces of HVAC components, such as drain plumbing or drain pans in an AHU.

Other features and advantages of the present invention will be apparent from the following more detailed description of the preferred embodiment, taken in conjunction with the accompanying drawings which illustrate, by way of example, the principles of the invention.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
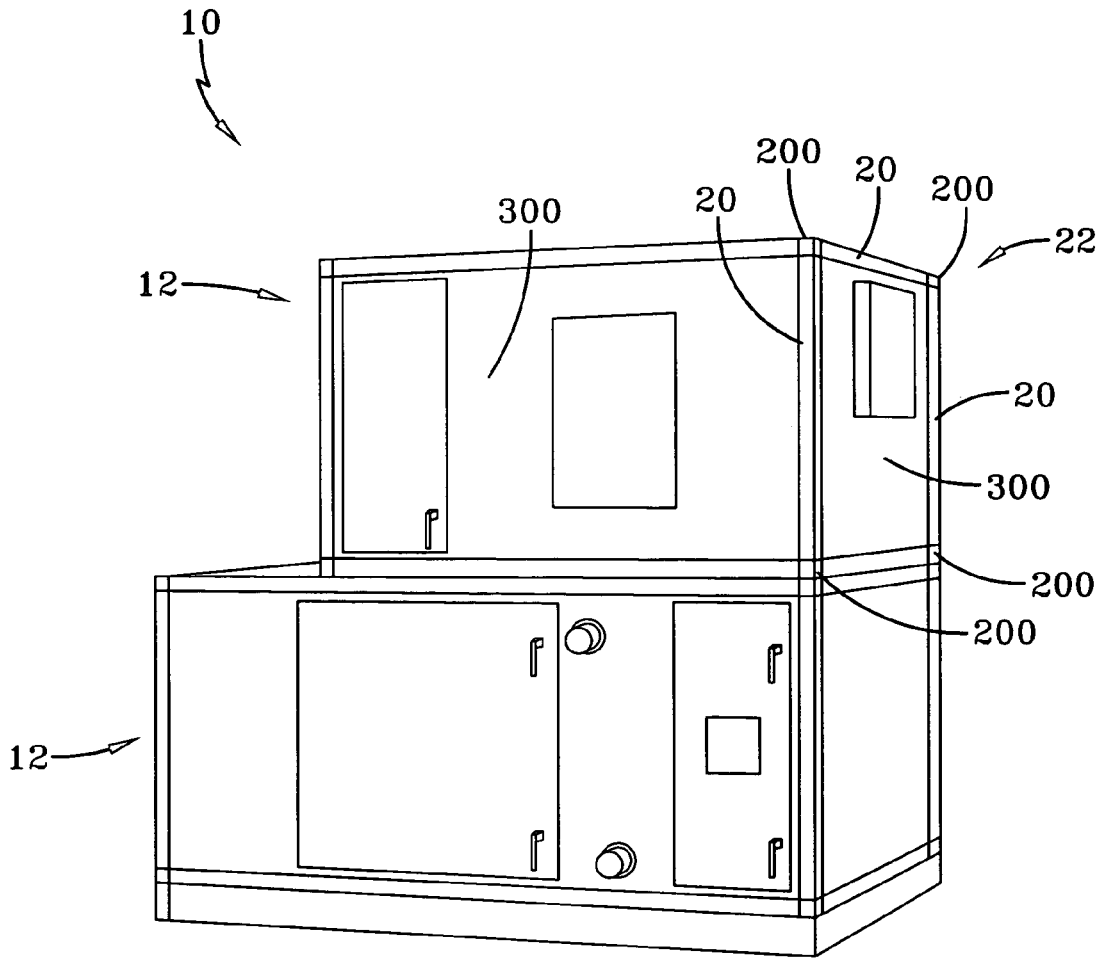
FIG. 1 is an overall perspective view of an AHU of the present invention.

One embodiment of an AHU 10 that incorporates a thermally enhanced component or construction of the present invention is depicted in FIG. 1. AHU 10 is an enclosed framed panel structure 12, or has a series of interconnected framed panel structures 12. Each framed panel structure 12 preferably defines a rectangular compartment that is configured to enclose or house components, which provide forced air for climate control in a particular structure. AHU components typically include motors, heating/cooling coils, and blowers as well as the required interface connections to these components to effect such climate control. Framed panel structures 12 have a plurality of insulated panels 300 that are each structurally and sealingly supported by a raceway frame 22. Each raceway frame 22 is comprised of a plurality, of raceways 20, preferably four, that are interconnected by corner members 200.

Figure 2:
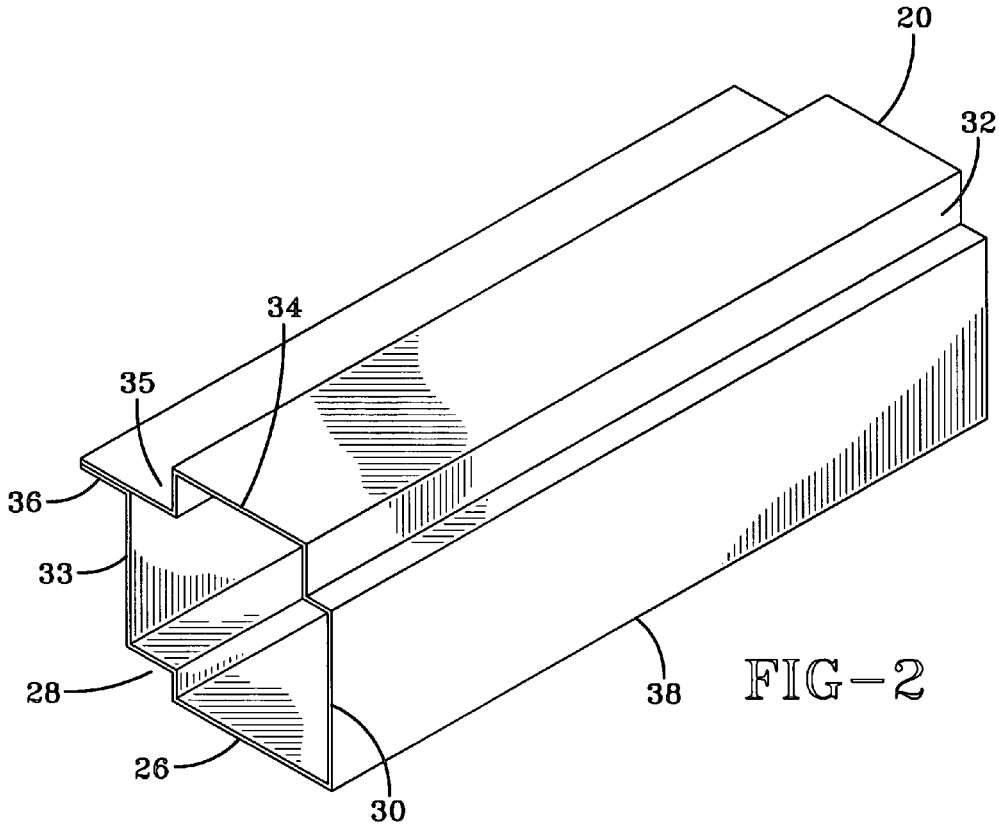
FIG. 2 is a perspective view of a raceway of the present invention.
Figure 3:
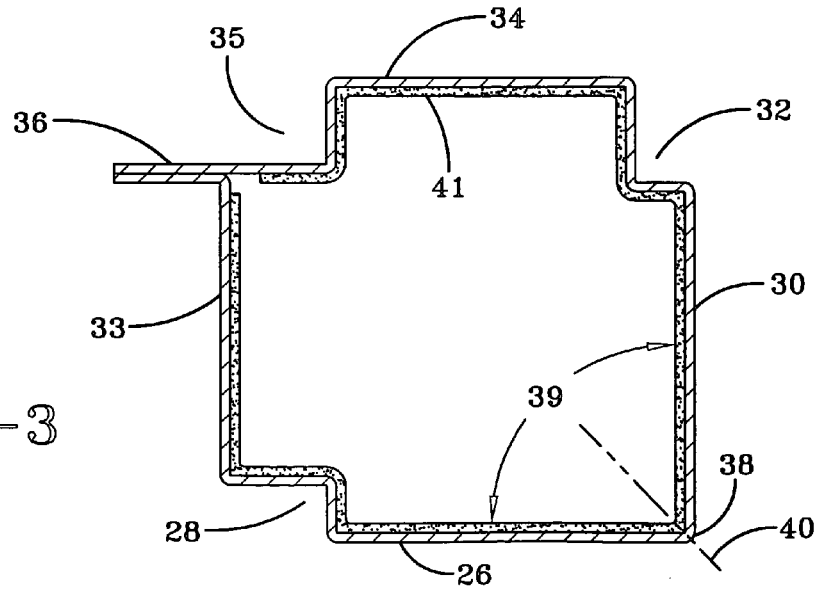
FIG. 3 is a cross section of the raceway of the present invention.
Figure 16:
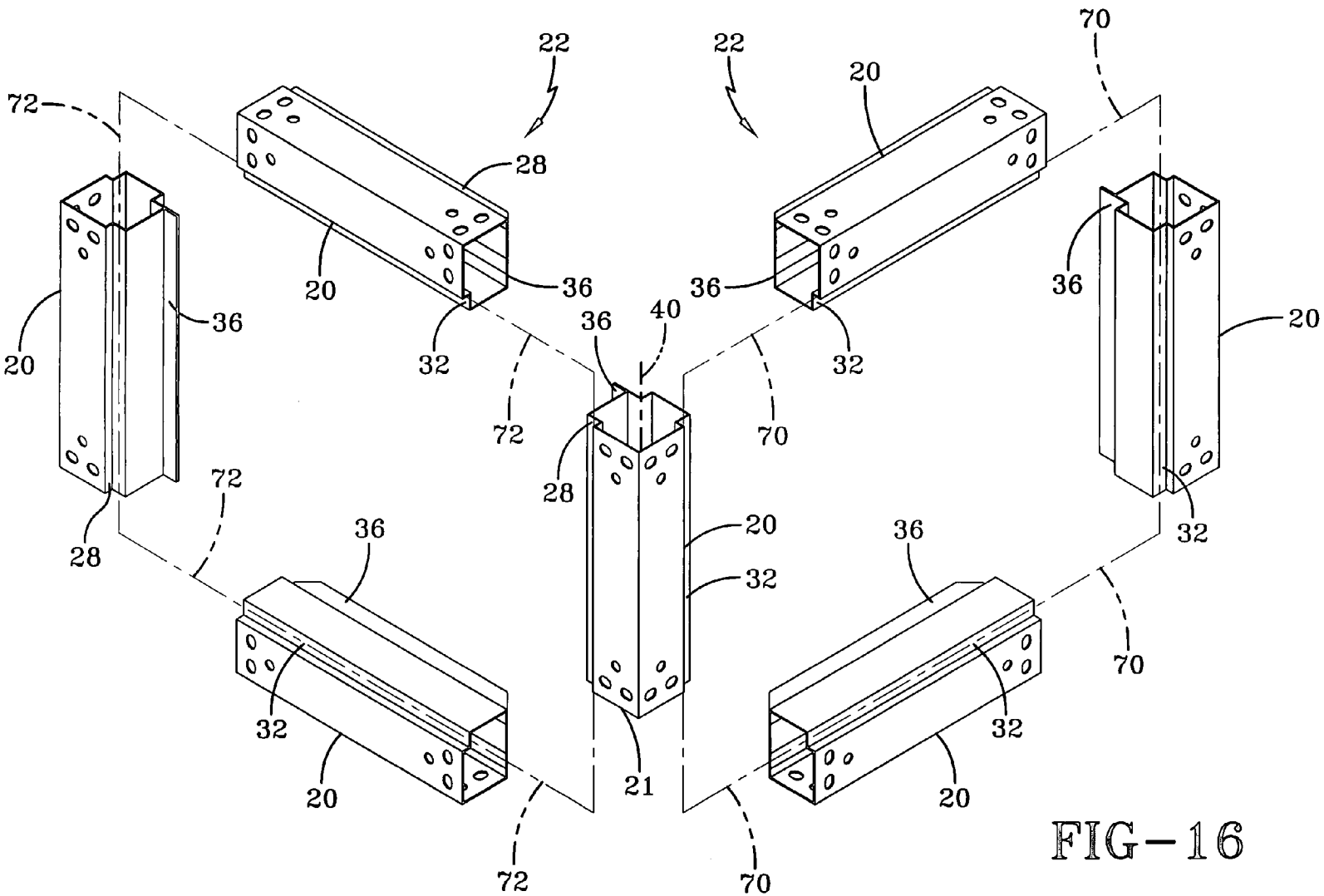
FIG. 16 is an exploded perspective view of adjacent raceway frames of the present invention.

Referring to FIGS. 2, 3 and 16, in a preferred embodiment of the present invention, raceway 20 defines a closed geometric profile including a first surface 26 which extends to a substantially squared first recess 28, a second surface 30 extending into a substantially squared second recess 32, a first closing portion 33 extending from first recess 28, a second closing portion 34 extending from second recess 32, a substantially squared third recess 35 extending from second closing portion 34, first closing portion 33 and third recess 35 terminating at a common flange 36. First and second surfaces 26, 30 have a common edge 38 and are substantially perpendicular to each other. The collective profile defined by first surface 26 and first recess 28 is a mirror image of the collective profile defined by second surface 30 and second recess 32 about a plane 40 (plane of symmetry) passing through common edge 38 that bisects angle 39 between first and second surfaces 26, 30. Preferably, first and second surfaces 26, 30 are orthogonal, thus, angle 39 is ninety degrees and plane 40 is forty five degrees from each of first and second surfaces 26, 30.

To form a preferably rectangular raceway frame 22 using the raceways 20, four mutually perpendicular, coplanar raceways 20 are interconnected end-to-end by corner members (not shown). By then interconnecting two opposed raceway frames 22 end-to-end using four raceways 20, wherein the end of each raceway 20 is connected to a corresponding corner of each of the two raceway frames 22, a rectangular framework is formed which defines a preferably rectangular structural framework for AHU 10. FIG. 16 shows two adjacent raceway frames 22 having a common raceway 21 that is common to each of the two raceway frames 22. Each of the raceway frames 22 includes a phantom outline 70, 72, defining a peripheral recess that is provided to receive a respective insulated panel 300 therein. Thus, a typical rectangular structural framework, which defines six open raceway frames 22, becomes an enclosed, interconnected framed panel structure upon receiving a respective insulated panel 300 in each of the peripheral recesses of the six raceway frames 22. By virtue of the symmetry of raceway 20, a single raceway profile may be used for each raceway 20 that is used to construct the structural framework for AHU 10 to provide identical, continuous peripheral seams or recesses for structurally securing each side of each insulated panel. While the above design for the raceway 20 is preferred, it is to be understood that any suitable design for raceway 20 can be used.

Secured to the inner surface of raceway 20 is a thermal barrier layer or material 41. The thermal barrier layer 41 may be secured to the inner surface by an adhesive applied to the side of the thermal barrier layer 41 that is placed in contact with the inner surface, or by a tape or fasteners. In other words, any means may be used to secure the thermal barrier layer 41 to the inner surface of the raceway 20 that is compatible with foam material, such as injected foam material, and does not prevent operation of the thermal barrier layer 41. Preferably, thermal barrier layer 41 has an uncompressed thickness from about 17 to about 20 mils (0.017 to 0.020 inches), although layers of reduced thickness, layers of increased thickness, and/or multiple layers of different thicknesses may also be used. It is also understood that the thickness of the layer may vary as installed, and/or the layer thickness may vary due to the compressive forces associated with installation, such as a high pressure foam injection process, as discussed in further detail below. The thermal conductivity of thermal barrier layer 41 is a function of thickness. The thermal barrier layer 41 can preferably be a plurality of non-woven ceramic fibers that form a lightweight, flexible sheet, e.g., is Nextel®, which is a registered trademark of 3M Company.

Preferably, the thermal barrier layer 41 is dimensionally stable over an extremely broad range of temperatures, and can withstand continuous temperatures of at least 2,200° F. without melting. It is also preferable that the fibers are non-respirable, and maintain their structural integrity and flexibility, even after the binders used during processing have worn off upon exposure to elevated temperatures.

While the thermal barrier layer 41 may be applied to the inner surface of the raceway 20 prior to forming the raceway 20, alternately, the thermal barrier layer 41 may be preformed to a desired configuration, such as a sock, and slid into the closed geometry defined by the raceway 20. In one embodiment, the thermal barrier layer 41 can span substantially the entire inner surface of the raceway 20 in order to meet particular flame and smoke index requirements. However, these requirements may also be achieved by affixing strip(s) of the thermal barrier layer 41 onto the inner surface of the raceway 20, either prior or subsequent to forming the raceway 20, partially covering the inner surface of the raceway 20. In another embodiment, the remaining portion of the minor surface of the raceway 20 can be covered when either or both of the inner surfaces of the first and second surfaces 26, 30 are at least partially covered. This is because the first and second surfaces 26, 30 are the two primary surfaces exposed to the outside conditions once the raceway 20 is assembled to form the interconnected frame 22.

Figure 4:
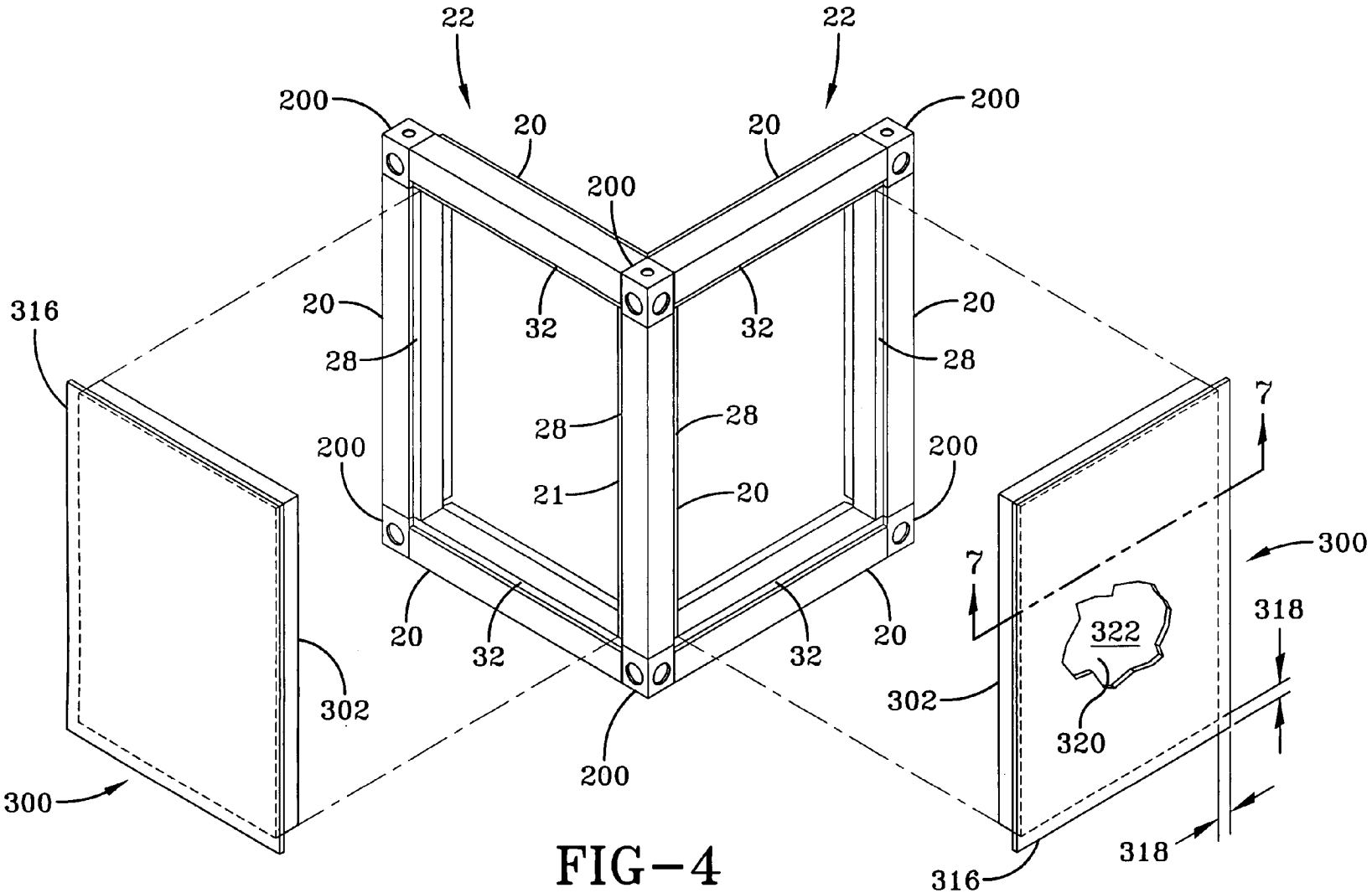
FIG. 4 is an exploded perspective view of insulated panels prior to insertion into adjacent raceway frames of the present invention.
Figure 5:
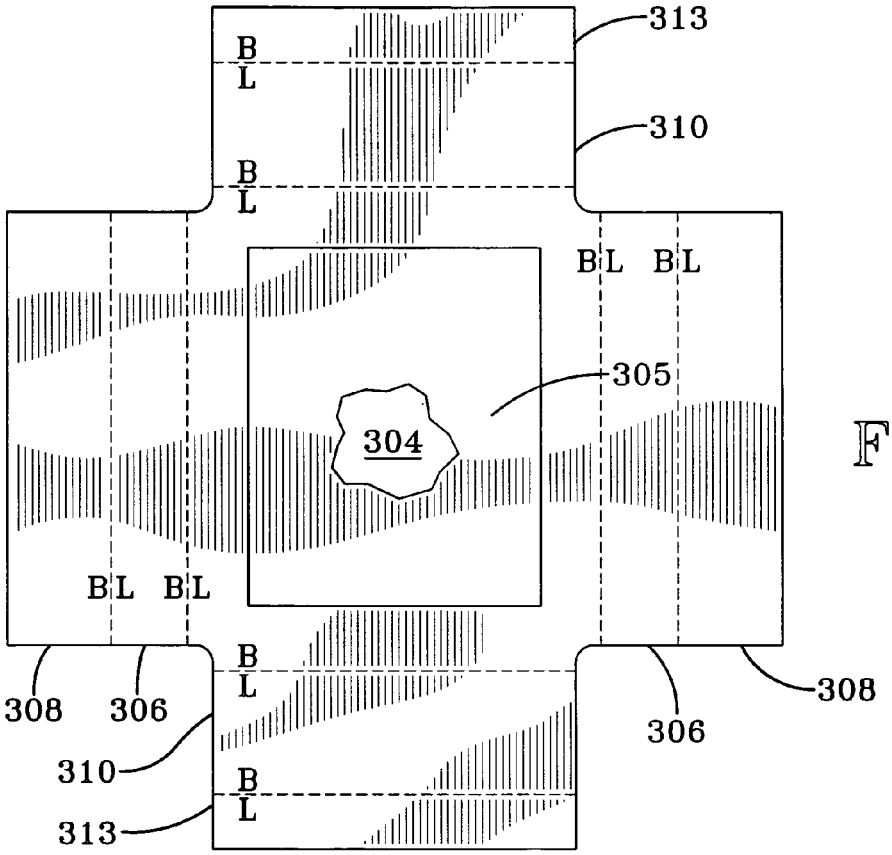
FIG. 5 is a flat pattern of a fixture of the insulated panel of the present invention.

Referring to FIG. 4, two adjacent raceway frames 22 each receiving the corresponding insulated panel 300 are shown, which raceway frame 22 has raceways 20 that are interconnected by corner members 200. Common to each raceway frame 22 is the raceway 20 that is located at the common corner, which raceway being referred to as a common raceway 21. One raceway frame 22 peripherally receives each of the four sides of the exterior skin 316 of its corresponding insulated panel 300 in second recess 32 formed in each raceway 20. While the other raceway frame 22 also peripherally receives the four sides of the exterior skin 316 of its corresponding insulated panel 300, two of the four sides of the exterior skin 316 are received in first recess 28 that is formed in two of the raceways 20, and the remaining two sides of the exterior skin 316 are received in second recess 32. Common raceway 21 (and each of the other vertically oriented raceways 20) can simultaneously secure one side of each of two different insulated panels 300, one side of insulated panel 300 being supported in first recess 28, and one side of insulated panel 300 being supported in second recess 32.

To increase the efficiency of the heating and cooling system, raceways 20 are injected with insulating material (not shown). Since the insulating material is preferably applied to substantially completely fill the interior of the raceways 20, the formation of condensation is likewise significantly eliminated which is a major cause of corrosion for the raceways 20, which are typically composed of metal, such as stainless steel or a galvanized coating applied to a steel alloy.

Referring to FIGS. 4-7, insulated panel 300 is provided for insertion in the first and/or second recesses 28, 32 formed along the raceways 20 that are interconnected by corner members 200 to form framed structures 22 used with AHUs. Insulated panel 300 of the present invention is constructed using a minimum of parts and may be sized according to a customer's individual needs to define any number of different aspect ratios and dimensions, preferably down to at least one inch increments, while still complying with structural stiffness standards, assembled air leakage standards, and desired flame and smoke index requirements. Additionally, a single panel construction may be employed irrespective the location of the panel in the AHU. That is, ceiling, wall and floor panel constructions are the same.

Figure 6:
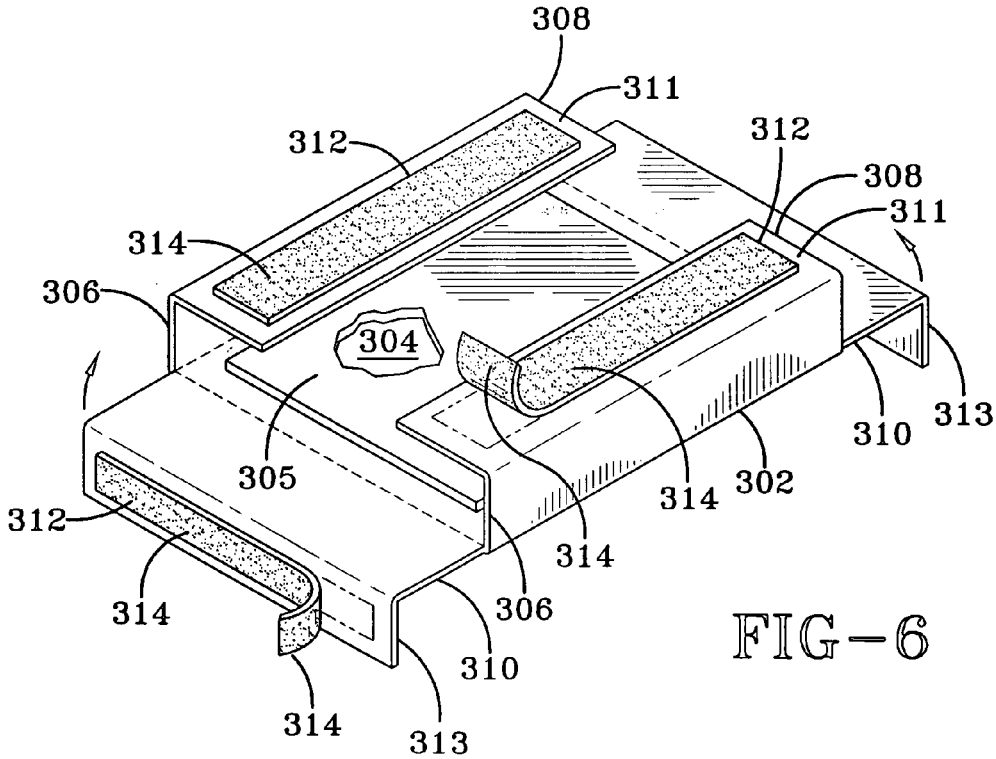
FIG. 6 is a perspective view of the partially fabricated fixture of the insulated panel of FIG. 5 of the present invention.

Fixture 302 is preferably constructed of sheet metal, such as stainless steel, although other materials for use in HVAC systems that are sufficiently formable or moldable with sufficient strength and heat resistant properties may also be used. Fixture 302 comprises a centrally positioned base 304 having opposed risers 306 extending from sides of base 304 in a direction perpendicular to base 304, which risers 306 further extend to outwardly (or inwardly) directed coplanar flanges 308. A thermal barrier layer 305 is preferably similar or identical to the material previously discussed for use with the raceways 20 and is secured to base 304. However, the thermal barrier layer 305 may extend to partially or totally cover any combination of risers 306, flanges 308 and opposed end risers 310 and coplanar inwardly or outwardly extending end flanges 313. When opposed risers 306, flanges 308, end risers 310 and end flanges 313 are rotated into a desired position, which opposed risers 306 and end risers 313 being substantially perpendicular to base 304, the assembled fixture 302 resembles a rectangular block with an opening into the block due to the space between opposed flanges 308 and end flanges 313. That is, if the opposed flanges 308, and/or the opposed end flanges 313 extend inwardly, the opening in the assembled fixture 302 is defined by the space between the opposed flanges 308 and/or the opposed flanges 313. However, if the opposed flanges 308 and/or the end flanges 313 extend outwardly, the opening in the assembled fixture 302 is defined by the space between the opposed risers 306 and opposed end risers 310. As shown in FIG. 6, the opposed flanges 308 extend inwardly, while opposed end flanges 313 extend outwardly. A layer of foam tape 312, such as polyethylene tape, having opposed adhesive layers 314 is applied along outside surfaces 311, 313 of each respective flange 308 and end flange 313 for bonding fixture 302 to the exterior skin 316. This foam tape 312 also has a low thermal conductivity, and serves as a thermal barrier to conduction. Alternately, other bonding methods or materials may be employed having similar physical properties.

Exterior skin 316, which is preferably a substantially flat rectangular plate, includes a thermal barrier layer 317. Although the thermal barrier layer 317 may have a rectangular shape that further includes an aspect ratio that is substantially similar to that of the exterior skin 316, the thermal barrier layer 317 may have any geometric shape, and may further include apertures of any predetermined size, shape and pattern, or lack of a pattern, so long as the thermal barrier operates or functions as discussed below. The exterior skin 316 is then positioned over fixture 302, the length of overhang 318 between the ends of the exterior skin 316 and the corresponding sides and ends of the fixture 302 preferably being substantially the same. Preferably, the thermal barrier layer 317 is both positioned along the exterior skin 316 and sized to fit within the footprint defined by the combination of the ends of the flange 308, the riser ends 313, the risers 306 and the end risers 310 of the fixture 302, which defines the smallest surface area. In other words, the thermal barrier layer 317 is preferably substantially centered with respect to the exterior skin 316 and the fixture 302. However, it may not be necessary to center the thermal barrier 317 within the footprint defined by the ends of the flange 308, the riser ends 310, the risers 306 and the end risers 310 of the fixture 302 on the inner surface of exterior skin 316 if the thermal barrier 317 can be configured into a tape that functions similar to tape 312. In one embodiment, the thermal barrier layer 317 can be formed into a tape and have a size with substantially the same dimensions as the exterior skin 316. That is, both the thermal barrier layer 317 and the exterior skin 316 can be cut simultaneously, saving manufacturing assembly time that might otherwise be expended centering the thermal barrier layer 317 on the inner surface of the exterior skin 316. Alternately, the tape 312 may be applied to the thermal barrier material 317, in which case the thermal barrier layer 317 can be sized to have substantially the same dimensions as the exterior skin 316. Once the exterior skin 316 is bonded to the fixture 302 by virtue of the tape 312 or by the thermal barrier layer 317, the assembled exterior skin 316, tape 312 (or thermal barrier tape 317) and fixture 302 collectively define a closed interior chamber 320 for receiving insulating material 322 therein.

The insulating material 322, such as polyurethane foam, is injected by an injection gun (not shown) inside the chamber 320 through apertures (not shown) formed in the exterior skin 316 using a specially configured press to ensure the fixture 302 and the exterior skin 316 are sufficiently supported against the force of the insulating material 322 that is injected at an elevated pressure level. The volume of the chamber 320 is calculated prior to the injection operation. A precise amount of insulating material 322 is injected into the chamber 320 by correcting for the ambient conditions at the time of injection as it is desirable to completely fill the chamber 320 with insulating material 322. Since the flow rate of the injected insulating material 322 through the injection gun is a known value, the duration of flow is the variable parameter which is precisely controlled to achieve the proper amount of injected insulation material 322. To provide a favorable bonding interface between the inner surfaces of the chamber 320 and the expanding, injected insulating material 322, the press platens that secure the exterior skin 316 and the fixture 302 may be heated, preferably up to about 100° F. for polyurethane foam material. Once the injection process is completed and the injected insulation material 322 has cured, the insulated panel 300 is installed in the AHU frame structure.

While desirable, it is not necessary for there to be a bonding interface between the inner surfaces of the chamber 320 and the expanding, injected insulating material 322. This is because the injected insulating material 322 substantially fills the chamber 320, providing significant rigidity that is sufficient for the insulated panels 300 to meet rigorous strength/deflection requirements. However, it may be possible to provide a combination of thermal barrier layers 305, 317 having reduced sizes with respect to their corresponding inner surfaces such that both the desired flame and smoke index requirements and increased rigidity and strength are achieved. Alternately, any combination of thermal barrier layers 305, 317 of various sizes, shapes and arrangements may further contain a plurality of apertures (not shown) formed in either or both of the thermal barrier layers 305, 317 in either a patterned or non-patterned arrangement to also provide increased rigidity and structural strength while continuing to satisfy the desired flame and smoke index requirements.

Figure 7:
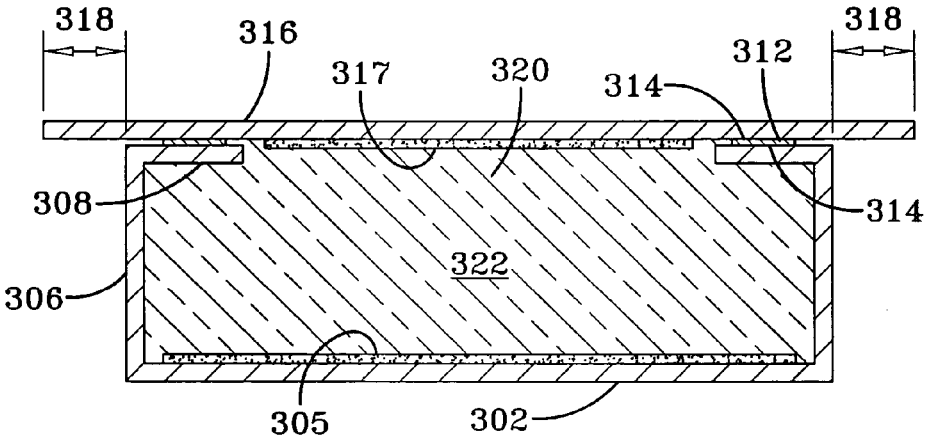
FIG. 7 is a cross section of the insulated panel taken along line 7-7 of FIG. 4 of the present invention.
Figure 15:
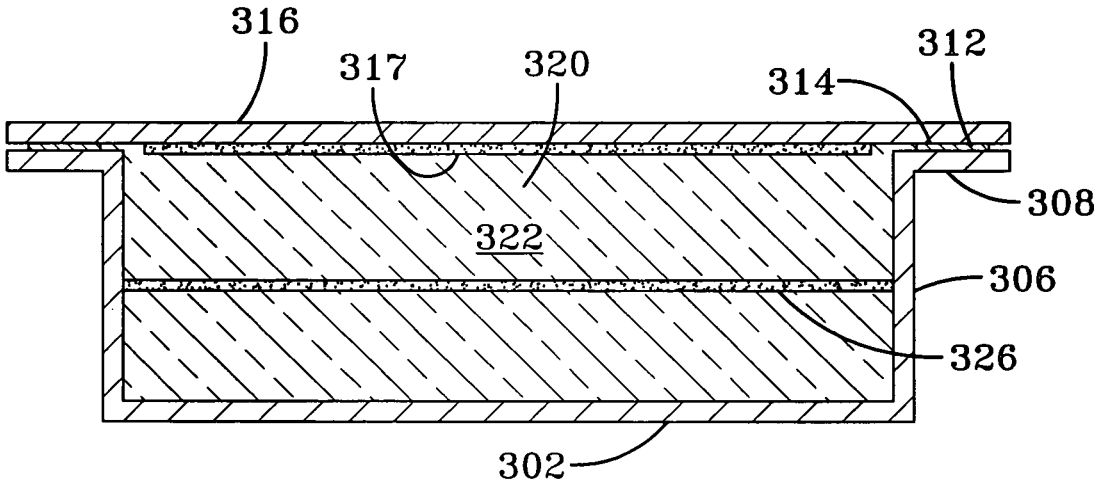
FIG. 15 is a cross section of an alternate embodiment of the insulated panel of the present invention.

Alternately, referring to FIG. 15, which is otherwise identical to FIG. 7 except as shown, the insulated panel 300 incorporates a divider 326 that is secured in a substantially mutual parallel attitude with the fixture 302 and the panel 316. The divider 326 substantially bisects the enclosed chamber 320 defined by the fixture 302 into two portions that are of substantially equal volume. Optionally, multiple dividers 326 may be used to further divide the enclosed chamber 320 into additional portions of reduced volume. Preferably, the divider 326 is a plate of substantially coplanar construction that may be secured in its position by spot welding the edges of the divider 326 to the corresponding portion of the inner surfaces of the riser 306. Alternately, the divider 326 could include extensions (not shown) for insertion into apertures formed in the risers 306, a set of grooves (not shown) formed in the inner surface of the riser 306 to receive the opposite ends of the divider 326, adhesive, or any mechanical, chemical or electrical means to secure the divider 326 in its desired position prior to the injection of foam material. Preferably, the divider 326 incorporates a plurality of venting apertures (not shown) and/or in the fixture 302 or the panel 316 sufficient to substantially equalize the forces acting on the opposed surfaces of the divider 326 during the foam injection process. Since the divider 326 divides the enclosed chamber 320 into two smaller, substantially equal portions, the thickness of either of the portions being approximately one inch in a preferred embodiment, the problems associated with smoke generation may be significantly reduced. For example, if injected polyurethane foam is used, the panel 300 may then be able to meet the desired smoke generation index without the thermal barrier layer 317. However, even if the panel 300 requires the thermal barrier layer 317, it is believed that the thermal barrier layer 317 may be of significantly reduced size, (i.e., surface area) or thickness than previously required when used in panel 300 without the divider 326.

Two separate tests, referred to as Experimental Run 1 and Experimental Run 2, respectively, were conducted in accordance with NFPA 90A per ASTM E84. For each test, three panels measuring 22⅞ inches wide by 22 feet 2¼ inches in total length were arranged horizontally with the three panels being joined end-to-end in the test furnace, simulating a ceiling installation in an AHU. The panels were conditioned in an atmosphere for 28 days at 70° F., 50% humidity prior to testing. The calibration material used to obtain zero index values for the flame spread and smoke indices was mineral fiber-reinforced cement board; red oak decks were used to obtain 100 index values for the flame spread and smoke indices.

Figure 9:
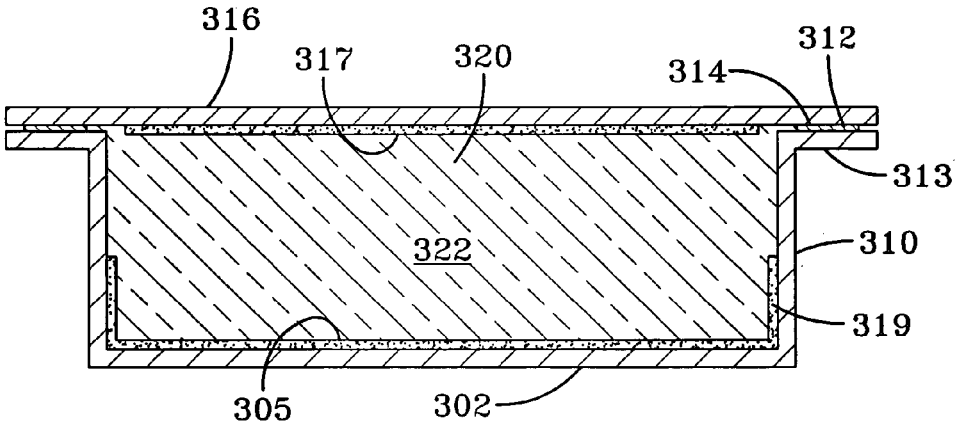
FIG. 9 is a cross section of the insulated panel used for a first test conducted of the present invention.

FIG. 9 shows a cross section of each of the three panels of Experimental Run 1. In FIG. 9, the thermal barrier 305 has a pair of opposed thermal barrier extensions 319, which are not present in the thermal barrier layer 41 in FIG. 7. A single sheet or layer of each of the thermal barriers 305, 317 having an uncompressed thickness of about 0.018 to about 0.020 inch were used in Experimental Run 1.

Figure 10:
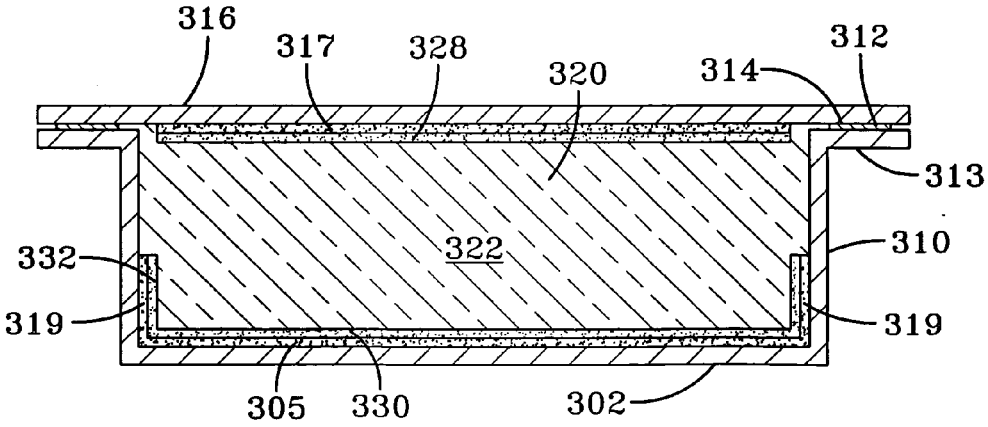
FIG. 10 is a cross section of the insulated panel used for a second test conducted of the present invention.

FIG. 10 shows a cross section of each of the three panels of Experimental Run 2. In FIG. 10 the thermal barrier 317 is overlaid by a thermal barrier 328, the thermal barrier 305 is overlaid by a thermal barrier 330 and opposed thermal barrier extensions 319 are each overlaid by a pair of opposed thermal barrier extensions 332. Each of the overlying thermal barrier layers was substantially the same size and thickness as its respective thermal barrier layer. Thus, double sheets or layers of each of the thermal barriers 305, 330 and thermal barriers 317, 328 each of about 0.018 to about 0.020 inch were used in Experimental Run 2.

Figure 11:
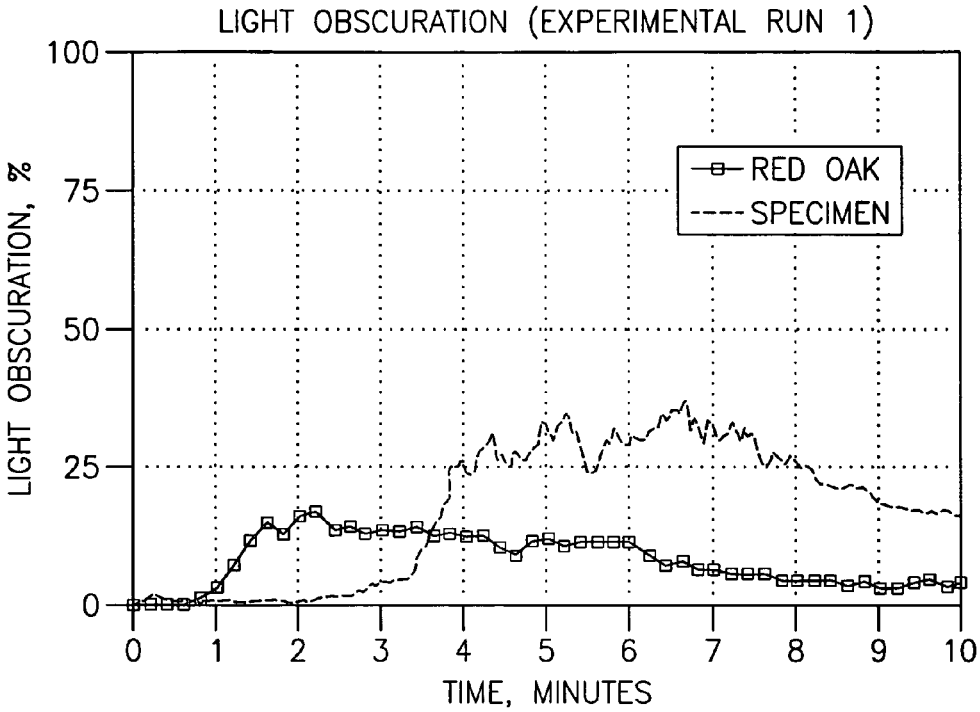
FIG. 11 is a graph showing smoke generation results from the first test of the present invention.
Figure 12:
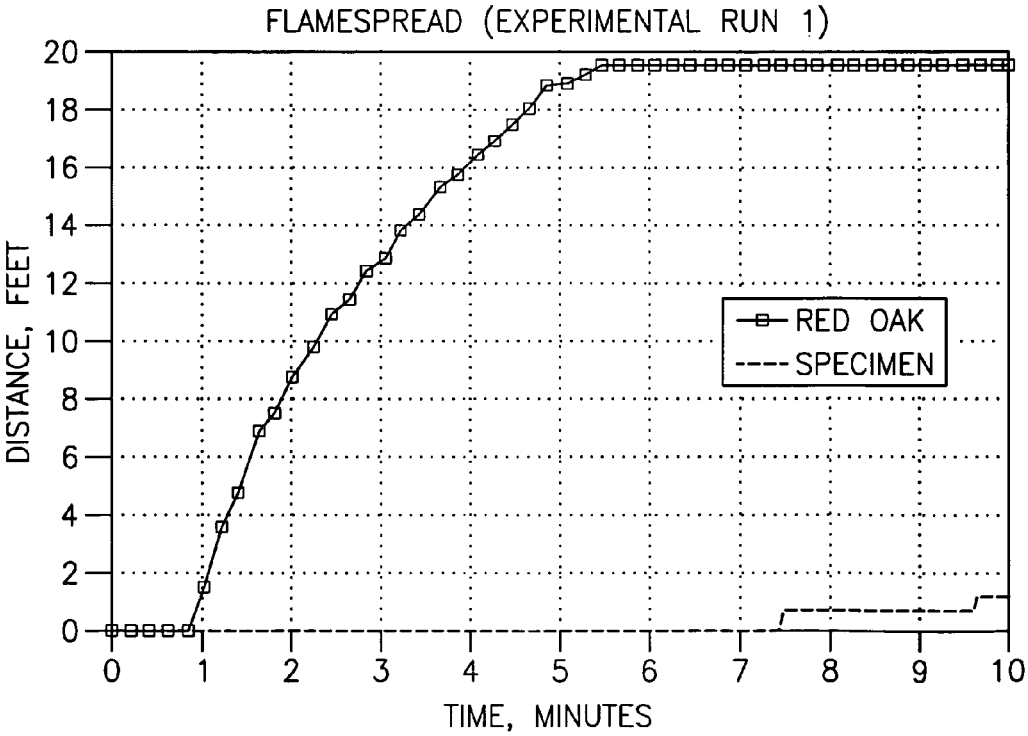
FIG. 12 is a graph showing flame spread results from the first test of the present invention.

FIGS. 11 and 12 show the test results for the smoke index and the flame spread index, respectively, for Experimental Run 1by comparing red oak to the insulated panels over the duration of the testing (10 minutes), the insulated panels being identified as "Specimen". Red oak represents both a smoke index and a flame spread index of 100, as previously discussed. The insulated panel produced more smoke than red oak, producing a higher level of light obscuration than red oak in FIG. 11. The smoke spread index based on FIG. 11 was calculated and rounded to a value of 195. This calculated smoke spread index value was a notable improvement as compared to a value of 205 that was obtained for a similar insulated panel having no thermal barriers. In addition to the smoke spread index value reduction, FIG. 11 shows that almost three and one-half minutes elapsed before a significant increase in light obscuration occurred. This was about a one minute improvement as compared to the test results for the insulated panel having no thermal barriers, or a percentage increase of about 40 percent. In practical terms, this notable improvement means that in a building fire, individuals attempting to flee the building may be provided additional time before significant smoke production and accumulation occurs, which improves the chances for escape. Additionally, the insulated panel produced significantly lower flame spread readings than red oak throughout the duration of the test in FIG. 12. The flame spread index based on FIG. 12 was calculated and rounded to zero, which calculated index value was significantly less than the permissible index value of 25.

Figure 13:
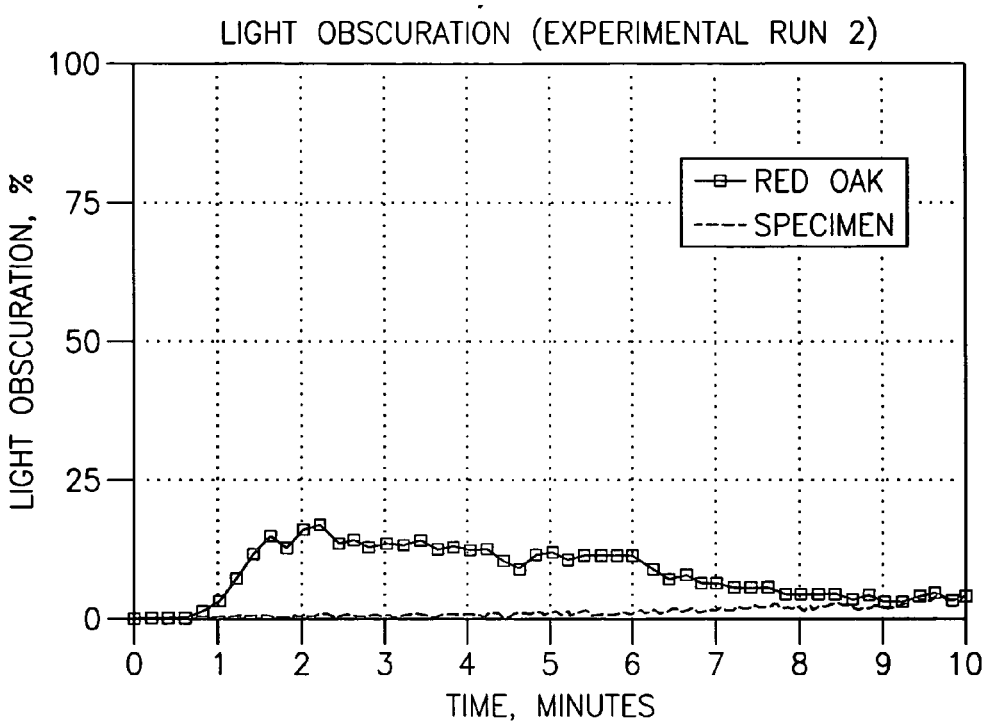
FIG. 13 is a graph showing smoke generation results from the second test of the present invention.
Figure 14:
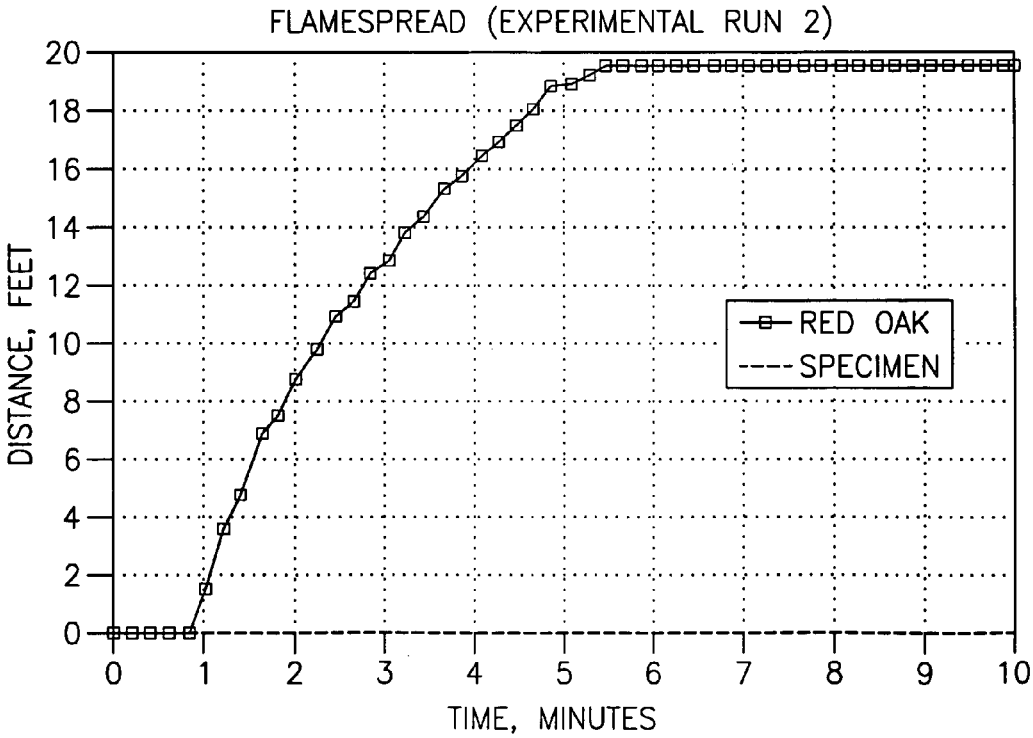
FIG. 14 is a graph showing flame spread results from the second test of the present invention.

FIGS. 13 and 14, show the test results for the smoke index and the flame spread index, respectively, for Experimental Run 2 by comparing red oak to the insulated panels over the duration of the testing (10 minutes), the insulated panels being identified as "Specimen". Red oak represents both a smoke index and a flame spread index of 100, as previously discussed. The insulated panel produced significantly less smoke than red oak over substantially the entire test duration, producing a consistently lower level of light obscuration than red oak in FIG. 13. The smoke spread index based on FIG. 13 was calculated and rounded to a value of 5. This calculated smoke spread index value was significantly less than the desired index value of 50. In addition to the significant smoke spread index value reduction, FIG. 13 shows that for the duration of the test, ten minutes, no significant increase in light obscuration occurred. This was at least about a seven and one-half minute improvement as compared to the test results for the insulated panel having no thermal barriers, or a significant percentage increase of about 400 percent. It is also possible that the improvement could have been significantly greater than about seven and one-half minutes because the test was halted after ten minutes, but prior to the occurrence of significant light obscuration due to smoke spread. In practical terms, this improvement means that in a building fire, individuals attempting to flee the building should be provided a markedly increased time before significant smoke production and accumulation occurs, which should likewise greatly improve the individuals' chances for escape from the building. Further, the insulated panel produced significantly lower flame spread readings than red oak throughout the duration of the test (10 minutes) in FIG. 14. The flame spread index based on FIG. 14 was calculated and rounded to zero, which calculated index value was significantly less than the permissible index value of 25.

The test results for Experimental Run 1 indicate that the single thermal barrier layer 317 applied to the inner surface of the exterior skin 316, and the single thermal barrier layer 305 applied to the inner surface of the fixture 302 of the insulated panel 300 provided notable smoke spread improvements over an insulated panel with no thermal barrier layers. Stated another way, Experimental Run 1 increased the amount of time by about 40 percent, i.e., about one minute, before significant smoke spread occurred due to the insulating material 322 being partially consumed by exposure to sufficiently elevated temperatures over an insulated panel with no thermal barrier layers. While the test results for Experimental Run 1 were notable, the smoke spread test results for Experimental Run 2 were significantly improved over Experimental Run 1.

To aid in analyzing the results, specifications of the insulating material used in the insulating panels in Experimental Runs 1 and 2 are provided below. In addition to the particular type of insulating foam material used for each of these tests, the particular geometry of the panels tested (the panel thickness being about 2 inches), corresponded to compressive forces of about 400 psi that were associated with injection of the foam. The insulating foam material had a density of about 2.2 pounds per cubic foot, a compressive strength measured in a direction perpendicular to rise (i.e., the direction of the panel thickness) of about 9 to about 13 psi, a modulus of about 220 to about 420 psi, and a shortened curing time since a heated fixture was used during the injection/curing process. With this combination of materials and conditions, the insulating material was designed to forcibly expand during the initial injection, exerting a high magnitude of compressive forces in all directions within the panel, but to discontinue application of the compressive forces during the curing process. That is, during the curing process, the forces associated with the injection and expansion of the foam material would essentially cease, but there would be substantially no shrinkage of the foam material. Stated another way, once the injection process was completed, the foam material substantially filled the closed interior chamber of the insulated panel.

In summary, the foam injection process subjected a high magnitude of compressive forces, approximately 400 psi, to the surfaces of the enclosed interior chamber and anything within the enclosed interior chamber. Upon completion of the injection process, the curing process followed, permitting substantially no shrinkage of the foam material. A resilient material, such as the thermal barrier layers 305, 317 was probably compressed (its thickness reduced) during the injection process. The injection process was followed by the curing process, in which the foam material substantially retained the volume achieved during the injection process. Therefore, without shrinkage of the foam material during or after curing, the only remaining way for either of the resilient thermal barrier layers 305, 317 to increase its thickness from its compressed thickness after the injection process, was for the reactive expansion forces in the thermal barrier layers 305, 317 to exceed the compressive strength of the foam material. That is, the residual restorative forces within the thermal barrier layers 305, 317 associated with the thermal barrier layers expanding to their original uncompressed thickness must be greater than the compressive strength of the foam material, or the thermal barrier layers would continue to be constrained to their compressed thickness.

As previously noted, the compressive strength perpendicular to the direction of rise (i.e., the thickness direction) for the foam material was from about 9 to about 13 psi. Therefore, it is highly likely that the thickness of each of the thermal barrier layers during the tests would be substantially the same as their compressed thickness. Thus, it is believed that the thermally insulative properties of the thermal barrier layers are dependent on the thickness of the thermal barrier layers when tested. Yet, despite the believed reduction in thermal performance, the insulated panel construction, which included thermal barrier layers, provided a notable improvement over an insulated panel construction that lacked the thermal barrier layers.

Test results also appear to clearly indicate in Experimental Run 2 that a desired smoke spread index value can be achieved by adding a second thermal barrier layer 328 over the thermal barrier layer 317 that was secured to the exterior skin 316. The stacking of two thermal barrier layers 317, 328, despite the layers being compressed during the injection process as previously discussed, provides sufficient additive thermal performance, possibly due to the effective thickness of compressed thermal barrier material layers 317, 328 after the foam has been injected. In an alternate embodiment of insulated panel 300, thermal barrier layers 305, 330 as well as thermal barrier layer extensions 319, 332 are removed, thus leaving thermal barrier layers 317, 328. However, it is believed that the sizes of thermal barrier layers 317, 328 may be reduced in size, and even have apertures formed therein while still achieving desired smoke and flame indexes.

In addition to permitting the insulated panels 300 to satisfy the desired flame and smoke index requirements, the thermal barrier layers 317, 328, and alternately, thermal barrier layer 305, possibly including thermal barrier extensions 319 or further possibly including respective overlying layers 330 and/or thermal barrier extension layers 332, may also provide improved acoustic attenuation performance. The insulated panels 300 without the thermal barrier layer may have a significant coincidence effect, which occurs at its critical frequency. Coincidence is defined as a significant reduction in sound transmission loss (i.e., a significant increase in the transmission of sound) through a partition that occurs at critical frequency. The critical frequency is the frequency at which the wavelength of sound in air equals the flexural bending wavelength in the partition or material. Stated another way, coincidence occurs when the wavelength of sound in air, projected on the plane of the panel 300, matches the bending wavelength of the panel 300. Coincidence is typically limited to flat panels. At coincidence, the panel 300 may be substantially transparent to sound at certain frequencies, such as about 1,000 Hz although panel thickness, aspect ratio and other factors may significantly change this frequency. Internal damping, if any, may help control the insertion loss. Without dampening, the insulating material 322 is tightly bonded to the inner surfaces of the fixture 302 and the exterior skin 316, the insulated panel 300 acting as a homogenous plate. That is, the insulating material 322 bonds the fixture 302 and the exterior skin 316 tightly together so that they move as one plate.

Any combination of the thermal barrier layers 305, 317 and thermal barrier extensions 319 may provide some dampening of the coincidence reduction at about 1,000 Hz, or other frequencies at which coincidence reduction occurs. Where the thermal barrier layers 305, 317 and/or thermal barrier extensions 319 are not be sized to substantially match the size of its corresponding fixture 302 or exterior skin 316, or have apertures formed in the thermal barrier layers 305, 317, as previously discussed, the corresponding bond between the thermal barrier layer 305, 317 and/or thermal barrier extensions 319 and its corresponding fixture 302 or exterior skin 316 is reduced. Due to this reduced bond, it is believed that the insulated panel 300 will no longer move as one plate. By no longer moving as one plate, coincidence of the panel 300 is reduced, thereby improving acoustic performance.

Figure 19:
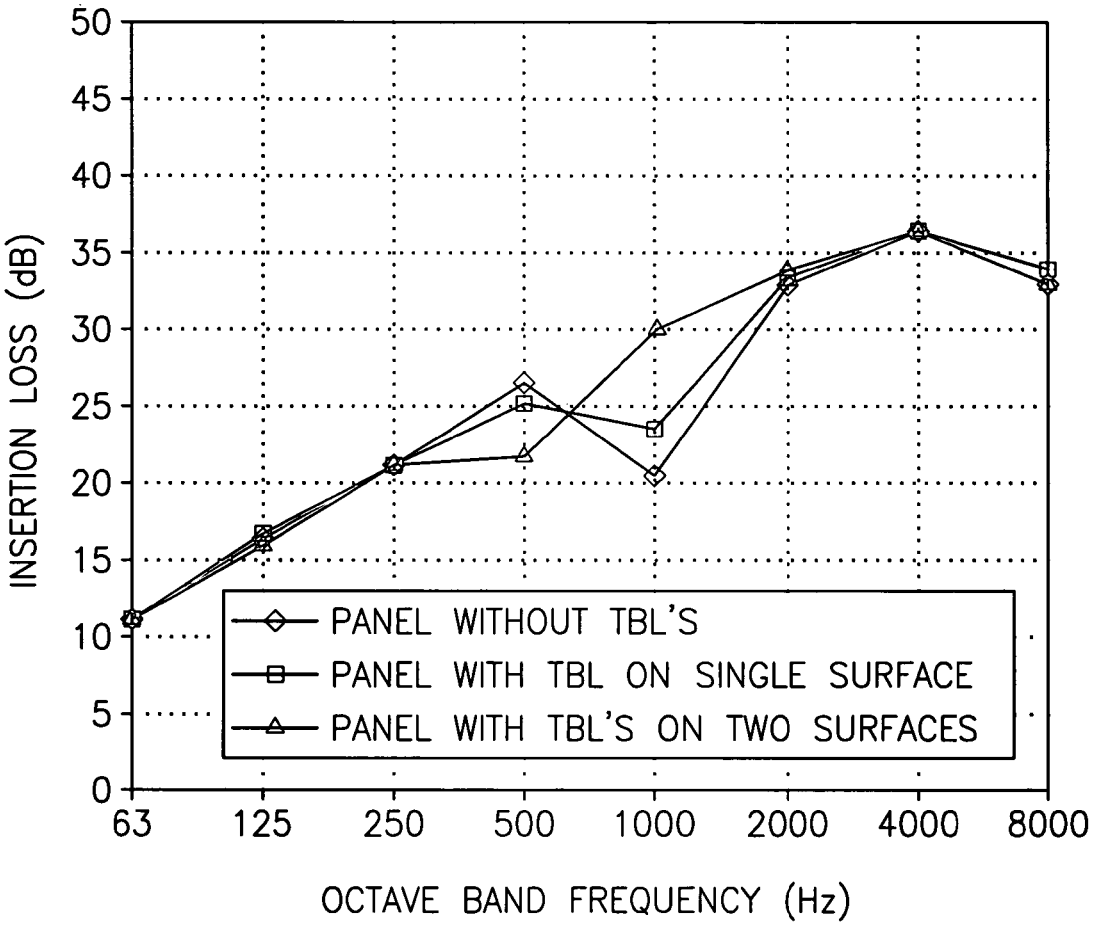
FIG. 19 is a graph showing acoustical sound power insertion loss results from testing of the present invention.

Referring to FIG. 19, acoustic tests were performed for three different panel constructions over a range of eight octave band frequencies. An octave band is a defined as a range of frequencies where the highest frequency of the band is twice that of the lowest frequency. For example the 125 Hz octave band represents the range of frequencies from 88.5 Hz to 177 Hz, 177 Hz being twice that of 88.5 Hz. The center frequency of each octave band listed along the x-axis of FIG. 19 is defined by the following equation:

$$fc=sqrt(f1\times f2) \quad [1]$$

f1 is the lowest band frequency and f2 is the highest frequency of the octave band. Applying equation [1] to the above-referenced octave band values yields the 125 Hz center frequency value. The first panel was of conventional construction, having no thermal barrier layers (TBLs). The second panel had two layers of thermal barrier material applied to one inside surface of the panel, such as thermal barrier layer 317 in FIG. 7. The third panel was similar to the second panel, except the third panel also had two layers of thermal barrier material applied to a second inside surface of the panel, such as thermal barrier layer 305 in FIG. 7.

As shown in FIG. 19, adding the thermal barrier layers significantly increased the amount of sound power insertion loss normally associated with the coincident frequency for the flat panels, which was about 1,000 Hz. For example, the second panel showed greater than a 14 percent increase in sound power insertion loss over the first panel at the coincident frequency. Similarly, the third panel showed about a 42 percent increase in sound power insertion loss over the first panel. Therefore, test results indicate the effects of coincidence can be significantly mitigated by the use of the thermal barrier layers of the present invention.

Figure 8:
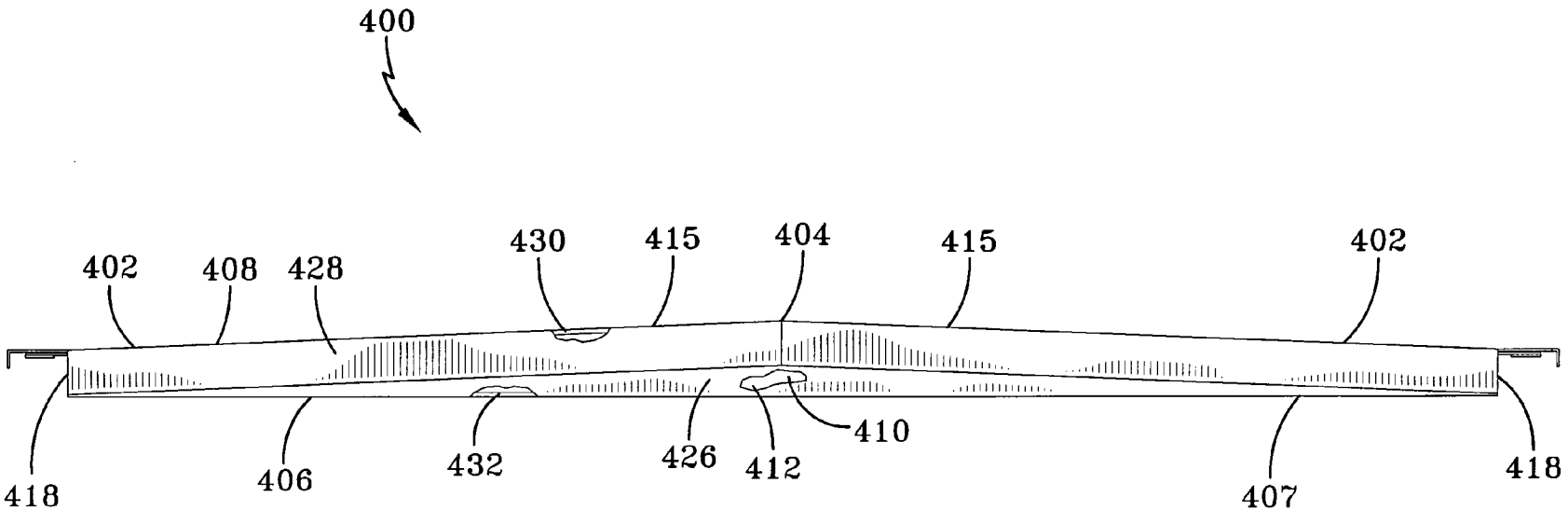
FIG. 8 is an elevation view of a sloped, insulated roof panel of the present invention.

Referring to FIG. 8, insulated roof assembly 400 provides a sloped roof surface for use with AHU structures of the present invention to prevent the formation and accumulation of standing water on the top of the AHU structures which are installed outside and subjected to the rigors of environmental exposure, such as rain or snow. Insulated roof assembly 400 is preferably of unitary construction comprising two sloped halves 402 abutting along the mid span 404 of the roofline, typically referred to as the peak of the roof. Each sloped half 402 includes a fixture 406 and an exterior skin 408, similar to that previously discussed for insulating panel 300. Similar to insulated panel 300, roof assembly 400 defines a closed chamber 410 for receiving injected insulating material 412 therein. That is, upon assembling fixture 406 to exterior skin 408, the collective interfacing surfaces including sloped surfaces 415 and flanges 428 of exterior skin 408, and a base 407, ends 418, and flanges 426 of fixture 406 define closed chamber 410. For similar reasons of additional stiffness and strength, as well as enhanced insulating properties for insulated panel 300, insulating material 412 is injected inside closed chamber 410 of roof assembly 400 in a manner substantially similar to that previously discussed for insulating panel 300.

Also, similar to the insulated panel 300, the roof assembly 400 can include any combination of thermal barrier layers 430, 432. The thermal barrier layer 430 is preferably applied to the inner surface of the exterior skin 408, and thermal barrier layer 432 is preferably applied to the inner surface of the base 407. It is also to be understood that either or both of the thermal barrier layers 430, 432 may extend to at least partially cover the inner surface of other portions of the fixture 406 and the exterior skin 408 of the roof assembly 400, such as the flanges 428, the ends 418, or any other portion of the roof assembly 400 having an exposed inner surface inside the roof assembly 400.

Aside from enabling foam-filled AHU structural components to meet the desired flame and smoke index requirements, the thermal barrier layer may be similarly used with gas, steam, and electrical heat components. These components include but are not limited to, freezer panels in appliances, such as refrigerators and freezers, commercial freezers, both enclosed and open units (such as those in supermarkets), any plumbing associated with any of the above, fire doors and the like, especially those using insulating foam material. However, as will be discussed in greater detail below, at least some of these components, such as drain pans, which may have no insulating foam material, can make advantageous use of the thermal barrier layer.

Despite its minimal thickness, the thermal barrier layer has the ability to maintain a significant temperature differential between its opposite surfaces, especially when one side is subjected to high temperature. That is, if one side of the thermal barrier layer is subjected to an elevated temperature of about 1,100° F., for example, the opposite surface of the thermal barrier layer is maintained at a temperature of approximately 650° F., resulting in a temperature differential of about 450° F. If multiple thermal barrier layers are stacked, then the temperature differential between the surface of the first thermal barrier layer that is subjected to the high temperature, and the opposite surface of the stacked thermal barrier layer that is furthest from the first thermal barrier layer, is greater than the temperature differential between opposite surfaces of the single thermal barrier layer.

At other temperatures, a temperature differential of about 440° F. results between opposite surfaces of a single thermal barrier layer when the one surface is subjected to an elevated temperature of about 750° F., and a temperature differential of about 230° F. results between opposite surfaces of a single thermal barrier layer when the one surface is subjected to an elevated temperature of about 400° F. Therefore, over a broad temperature range, the thermal barrier layer reduces heat transmission by about 35 percent to about 45 percent.

In other words, even in the absence of insulating foam, where used, the thermal barrier layer operates to help moderate and thereby protect components exposed to elevated or reduced temperature environments. In elevated temperature environments, the thermal barrier layer is interposed between the elevated temperature environment and components that are to be protected from the elevated temperature environment. The thermal barrier layer is intended to minimize the temperature of the surface facing the protected components, which reduces both the flame spread and the smoke spread of the protected components. Similarly, in reduced temperature environments, such as those associated with refrigeration cycles, the thermal barrier layer is interposed between a reduced temperature environment and components that are to be protected from the reduced temperature environment. The thermal barrier layer may maximize the temperature of the surface facing the protected components.

Among the possible benefits of the thermal barrier layer maximizing the temperature of the surface facing the protected components, in addition to efficiency of operation of HVAC systems, is the substantial reduction, if not prevention, of condensation that collects on HVAC component surfaces. Condensation is defined as the conversion of a substance (i.e., water) from the vapor state to a denser liquid or solid state usually initiated by a reduction in temperature of the vapor. Due to the reduced temperatures of the surfaces of HVAC components, ambient air passing in contact with these components are likewise cooled, which reduces the ability of the air to retain moisture (water), resulting in the formation of condensation on these surfaces. The amount of water formed by condensation can be significant, often requiring systems or techniques for removal, at increased cost to the user. Additionally, condensation is a source of corrosion of metallic components, and if the condensation collects beneath a HVAC unit, such condensation may be the source of structural damage.

To minimize condensation, the thermal barrier layer may be protectively secured or applied to or adjacent to the inner surface of the HVAC component, such as a drain pan, such that the thermal barrier layer is not directly exposed to the operations associated with the surface of the HVAC component to prevent possible contamination from or damage to the thermal barrier layer. Alternately, the thermal barrier layer may be disposed within the HVAC component during its manufacture.

Figure 17:
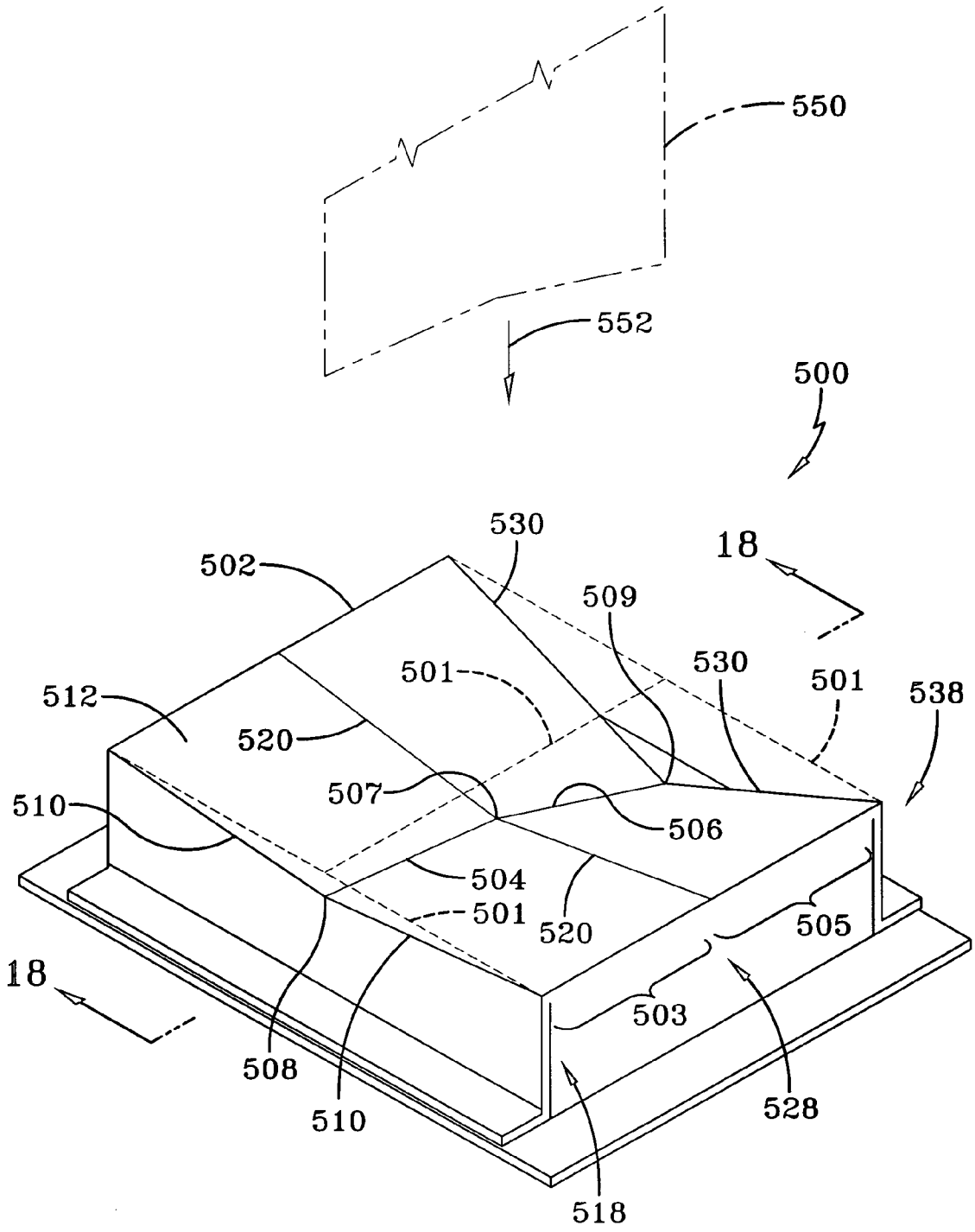
FIG. 17 is a perspective view of an embodiment of the insulated panel of the present invention.
Figure 18:
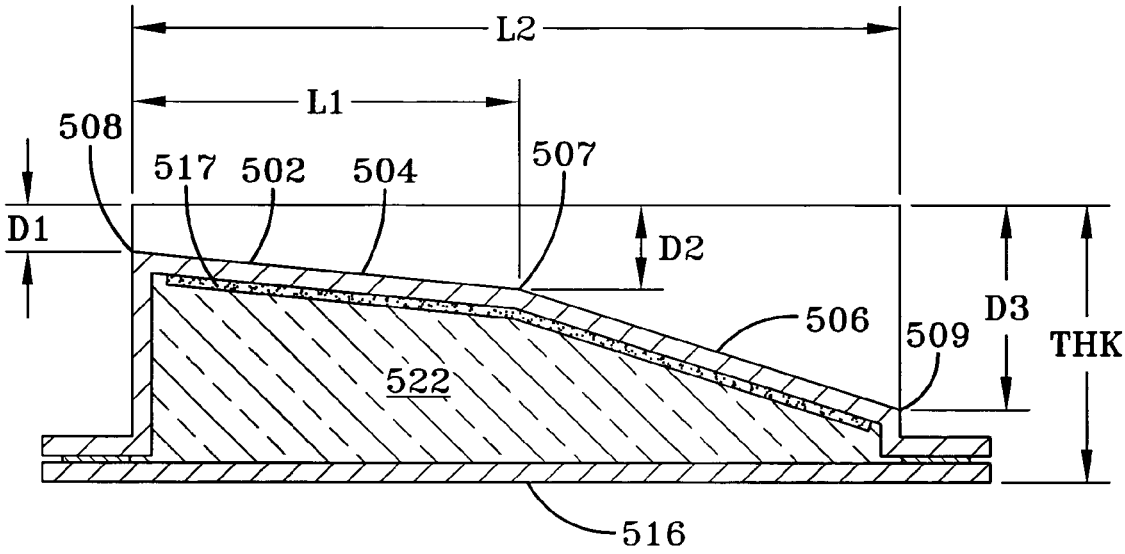
FIG. 18 is a cross section of the insulated panel taken along line 18-18 of FIG. 17 of the present invention.

For example, FIGS. 17-18 illustrate an embodiment of an insulated panel 500, which is otherwise the same as insulated panel 300 as previously discussed, but is specifically configured for use as a floor panel in the AHU 10. In other words, the insulated panel 500 not only performs the same functions as the insulated panel 300, but the insulated panel 500 is also specially configured to provide a drain pan for collecting and removing condensation that collects on its outer surface 512. The condensation collected by the insulated panel 500 initially forms on cooling coils (not shown) that are positioned within the AHU 10 above the insulated panel 500. During operation of the cooling coils, air passing along the cooling coils is cooled sufficiently to lose its ability to retain moisture, the moisture (condensation) being deposited as droplets on the surface of the cooling coils. The condensation continues to accumulate on the surface of the cooling coils, and once the droplets combine to reach a sufficient size, due to gravity, the condensate droplets fall from the surface of the cooling coils, and accumulate upon the outer surface of the insulated panel 500.

To facilitate the collection and removal of this condensation from the insulated panel 500, the outer surface 512 of the sheet metal fixture 502 is provided with a first sloped portion 503 and a second sloped portion 505. The first sloped portion 503 and the second sloped portion 505 are formed during the manufacture of the insulated panel 500, such as by a narrow blade 550 that is brought into deforming contact with the fixture 502 as the blade 550 travels in a direction 552. For reference, an undeformed profile 501 or outline of the fixture 502 is provided. While it may be preferable for the first and second sloped portions 503, 505 to be formed prior to injection of insulating material, it may also be possible to form the first and second sloped portions 503, 505 after the injection process.

The first sloped portion 503 includes a proximate half of the outer surface 512 of the fixture 502, and the second sloped portion 505 includes the remaining distal half of the outer surface 512 of the fixture 502. Each of the first and second sloped portions 503, 505 are represented as substantially V-groove profiles, although other profiles may also be used. The first sloped portion 503 begins with a proximal V groove 518 and transitions to and terminates at a midspan V groove 528. A base 504, which defines the base of the V groove contour formed in the first sloped portion 503, connects the base of the proximal V groove 518 to the base of the V groove 528. The second sloped portion 505 begins with the midspan V groove 528 and transitions to and terminates at a distal V groove 538. A base 506, which defines the base of the V groove contour formed in the second sloped portion 505, connects the base of the midspan V groove 528 to the base of the distal V groove 538.

The proximal V groove 518 is preferably defined by a pair of opposed proximal corners 510 that are connected at a proximal corner point 508. The proximal corner point 508 is positioned at a depth of "D1" below the undeflected panel profile 501, which depth D1 preferably being about one-fourth of an inch. At a predetermined distance "L1" as measured along the undeflected panel profile 501, which is substantially in the direction of the base 504, is a center point 507 that is preferably positioned at the center of the undeflected panel profile 501 of the fixture 502. Thus, L1 is preferably one-half of the distance "L2" which is the length of the groove as measured along the undeflected profile 501. The center point 507 is preferably positioned at a depth of "D2" below the undeflected panel profile 501, which depth D2 preferably being about one-half inch. To trace the midspan V groove 528, the base of the midspan groove 528, which is defined by the center point 507, connects opposed midspan edges 520. The midspan edges 520 are coincident with the outer surface 512.

The first sloped portion 503 is defined on its proximal end by the proximal V groove 518, the proximal corners 510 of the proximal V groove 518 coinciding with the outer surface 512. Thus, while proceeding distally along base 504 toward the midspan V groove 528 of the fixture 502 from the proximal V groove 518, the proximal corners 510 of the proximal V groove 518, which transition to the midspan edges 520 of the midspan V groove 528, remain coincident with the outer surface 512. Stated another way, the surface of the first sloped portion 503 coincides with the proximal half of the outer surface 512. It is noted that the slope of the base 504 of the transitioning V grooves corresponding to the first sloped portion 503 may be determined by calculating the difference between the center point 507 and the proximal corner point 508 (D2-D1) divided by L1.

The second sloped portion 505 transitions uninterrupted from the first sloped portion 503 since the second sloped portion 505 is defined on its proximal end by the midspan V groove 528, which coincides with the distal end of the first sloped portion 503. Similar to the first sloped portion 503, the second sloped portion 505 continues to coincide with the distal half of the outer surface 512. In other words, while proceeding distally along base 506 toward the distal V groove 538 of the fixture 502 from the midspan V groove 528, the midspan edges 520 of the midspan V groove 528, which transition to the distal corners 530 of the distal V groove 538, remain coincident with the outer surface 512. Stated another way, the surface of the second sloped portion 505 coincides with the distal half of the outer surface 512. The distal V groove 538 is defined by a pair of opposed distal corners 530 which are joined at the base of the V groove 538 at a distal corner point 509. The distal corner point 509 is positioned a distance "D3" below the undeflected surface 501, which depth D3 preferably being about one and one-half inch. Thus, the base of the transitioning V grooves for the second sloped portion 505 can be traced along the base 506 between the center point 507 and the distal corner point 509. It is noted that the slope of the base 506 of the transitioning V grooves corresponding to the second sloped portion 505 may be determined by calculating the difference between the center point 507 and the distal corner point 509 (D3-D2) divided by the difference between L2 and L1 (L2-L1). The increase slope 506 provides for improved removal of condensation from the outer surface 512 of the fixture 502.

In operation, condensation falling onto the sloped outer surface 512 of the fixture 502 of the insulated panel 500 will be urged, by force of gravity, to proceed along the V grooves defined by the first and second sloped portions 503, 505.

Upon passing the distal corner point 509 of the fixture 502, the condensation passes through a passage formed in a raceway (not shown) to exit the AHU 10.

While the concept of forming a two-tiered V groove in the insulated panel 500 eliminates additional components, the significant depth of distal corner point 509 as compared to the total thickness of the insulated panel 500, identified as "THK", which is typically about 2 inches for an undeflected panel profile in a preferred embodiment, leaves only about one-half inch of remaining thickness adjacent the distal end of the distal half of the panel. This reduced thickness means there is likewise less insulating material 522 at the distal region of the insulated panel 500 to insulate the lower surface of the exterior skin 516. Without sufficient insulation, the lower surface of the exterior skin 516, which is the surface of exterior skin 516 that faces in a direction away from the fixture 502, may drop to a temperature that will cause condensation to form along the lower surface of the exterior skin 516. This condensation, which flows from beneath the AHU, is unattractive, may promote the growth of mold, may provide a slipping hazard, and may promote corrosion of the AHU.

To substantially reduce, if not prevent, condensation from forming along the lower surface of the exterior skin 516, a thermal barrier layer 517 may be secured to the inner surface of the fixture 502. In this application, the thermal barrier layer 517 maintains a sufficient temperature differential between the surface of the thermal barrier layer 517 facing the outer surface 512 of the fixture 502 and the opposite surface of the thermal barrier layer 517 such that condensation is substantially prevented from forming along the lower surface of the insulated panel 500.

One skilled in the art can appreciate that the thermal barrier layer may also be protectively secured or applied to or adjacent to the outer surface of the HVAC component or anywhere within the casing or housing of the HVAC component so long as the thermal barrier layer functions to sufficiently raise the surface temperature of the HVAC component surface exposed to surrounding ambient conditions to substantially minimize, if not prevent, the formation of condensation on the surface of the HVAC component. HVAC components include, but are not intended to be limited to ducting, drains, drain pans, or any associated components having a reduced surface temperature. Further, this invention is not limited to HVAC components, and is contemplated to include components on which condensation forms, such as plumbing or containers that hold substances of reduced temperature, the reduced temperature not being the result of an HVAC system, such as water collection from a source having a reduced temperature.

It is further appreciated that any foam-filled enclosed container for use in the construction of walls or partitions for residential or commercial structures can incorporate the thermal barrier layer of the present invention.

Additionally, the thermal barrier layer of the present invention may be used with household appliances, walk-in coolers, refrigerated display cases and HVAC units.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A thermally-enhanced component comprising:

a substantially enclosed and contiguous air handling unit structure having an interior surface and an exterior surface;

at least one sheet of a non-woven ceramic material having opposed surfaces being disposed inside the structure at a predetermined distance from the exterior surface of the structure, the at least one sheet being configured to provide a thermal barrier;

insulating material disposed inside the structure and in contact with at least one surface of the at least one sheet, the insulating material having a predetermined rate of smoke generation at a predetermined temperature sufficient to produce smoldering; and wherein the at least one sheet being configured and disposed to provide a sufficient temperature differential between the opposed surfaces of the at least one sheet to reduce the predetermined rate of smoke generated by the insulating material upon the exterior surface of the structure being subjected to the predetermined temperature.

2. The thermally-enhanced component of claim 1 wherein the at least one sheet is flexible.

3. The thermally-enhanced component of claim 1 wherein the at least one sheet is positioned in contact with an inner surface of the component.

4. The thermally-enhanced component of claim 1 wherein the component is a raceway.

5. The thermally-enhanced component of claim 1 wherein the component is a panel.

6. The thermally-enhanced component of claim 5 wherein the panel has a reduced coincidence effect at its critical frequency.

7. The thermally-enhanced component of claim 6 wherein the critical frequency is about 1,000 Hz.

8. The thermally-enhanced component of claim 1 wherein the uncompressed thickness of the at least one sheet is about 0.017 inch.

9. The thermally-enhanced component of claim 1 wherein the uncompressed thickness of the at least one sheet is between 0.017 inch and about 0.020 inch.

10. The thermally-enhanced component of claim 1 wherein the at least one sheet of a non-woven ceramic material includes at least two sheets of a non-woven ceramic material, the at least two sheets of a non-woven ceramic material are disposed inside the structure at a predetermined distance from one another.

11. The thermally-enhanced component of claim 1 wherein the insulating material is a polyurethane foam.

12. The thermally-enhanced component of claim 11 wherein the polyurethane foam is injected into the component.

13. A thermally-enhanced component comprising:

a substantially enclosed and contiguous HVAC system structure having an interior surface and an exterior surface, the structure being substantially filled with an insulating material;

at least one sheet of a non-woven ceramic material having opposed surfaces being disposed inside the structure at a predetermined distance from the exterior surface of the structure, the at least one sheet being configured to provide a thermal barrier;

insulating material disposed inside the structure and in contact with at least one surface of the at least one sheet, the insulating material having a predetermined rate of smoke generation at a predetermined temperature sufficient to produce smoldering; and wherein upon the exterior surface of the structure being subjected to the predetermined temperature, the at least one sheet providing a sufficient temperature differential between the opposed surfaces of the at least one sheet to reduce the predetermined rate of smoke generated by the insulating material.

14. The thermally-enhanced component of claim 13 wherein the at least one sheet is flexible.

15. The thermally-enhanced component of claim 13 wherein the component is a raceway.

16. The thermally-enhanced component of claim 13 wherein the component is a panel.

17. The thermally-enhanced component of claim 16 wherein the panel has a reduced coincidence effect at its critical frequency.

18. The thermally-enhanced component of claim 17 wherein the critical frequency is about 1,000 Hz.

19. The thermally-enhanced component of claim 13 wherein the component is a door.

20. The thermally-enhanced component of claim 13 wherein the component is any one of ducting, drains or drain pans for connecting other HVAC components.

21. The thermally-enhanced component of claim 13 wherein the component is a refrigerated display case.

22. The thermally-enhanced component of claim 13 wherein the component is a walk-in cooler.

23. The thermally-enhanced component of claim 13 wherein the component is a household appliance.

* * * * *